US007971285B2

(12) United States Patent
Chew

(10) Patent No.: US 7,971,285 B2
(45) Date of Patent: Jul. 5, 2011

(54) TOILET SEAT WITH ANOCOCCYGEAL SUPPORT

(75) Inventor: Heng Hai Chew, Penang (MY)

(73) Assignee: Mecha-Medic Solution Sdn. Bhd., Panang (MY)

( * ) Notice: Subject to any disclaimer, the term of this patent is extended or adjusted under 35 U.S.C. 154(b) by 296 days.

(21) Appl. No.: 12/310,053

(22) PCT Filed: Aug. 18, 2006

(86) PCT No.: PCT/MY2006/000003

§ 371 (c)(1),
(2), (4) Date: Feb. 9, 2009

(87) PCT Pub. No.: WO2008/020751

PCT Pub. Date: Feb. 21, 2008

(65) Prior Publication Data

US 2009/0265843 A1 Oct. 29, 2009

(51) Int. Cl.
*A47K 13/00* (2006.01)

(52) U.S. Cl. ..... 4/237

(58) Field of Classification Search ..... 4/234–241
See application file for complete search history.

(56) References Cited

U.S. PATENT DOCUMENTS

| | | | | |
|---|---|---|---|---|
| 2,256,994 | A * | 9/1941 | Warshaw | 4/237 |
| 2,985,171 | A * | 5/1961 | Wiederman | 606/201 |
| 4,048,679 | A * | 9/1977 | Garnett | 4/237 |
| 4,189,794 | A * | 2/1980 | Aleman-Mucino | 4/237 |
| 4,244,063 | A * | 1/1981 | Bayard | 4/237 |
| 6,584,621 | B2 * | 7/2003 | Kim | 4/237 |
| 2004/0194197 | A1 * | 10/2004 | Eft | 4/237 |

FOREIGN PATENT DOCUMENTS

FR 2601585 * 2/1988

* cited by examiner

*Primary Examiner* — Charles Phillips
(74) *Attorney, Agent, or Firm* — Brinks Hofer Gilson & Lione

(57) ABSTRACT

A toilet seat which comprises of a recess (1) located at its posterior end with a supporting means (2) situated within it, such that the tip (3) of the supporting means (2) provides the much needed support to the anoccocygeal part of the pelvic floor of the human body.

5 Claims, 6 Drawing Sheets

FIG. 5
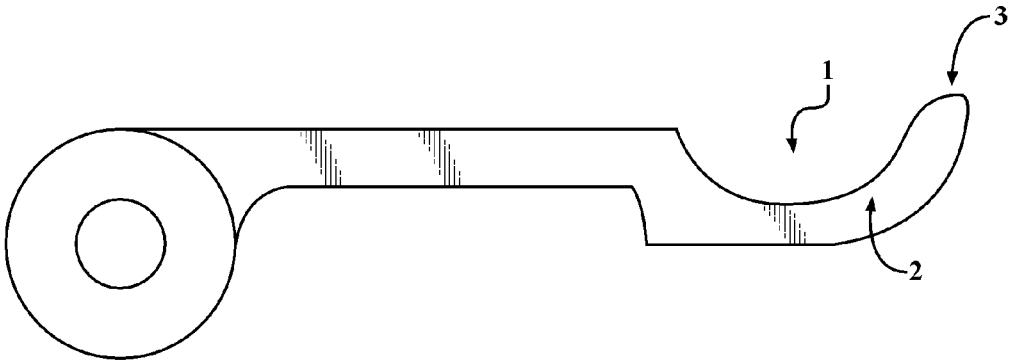
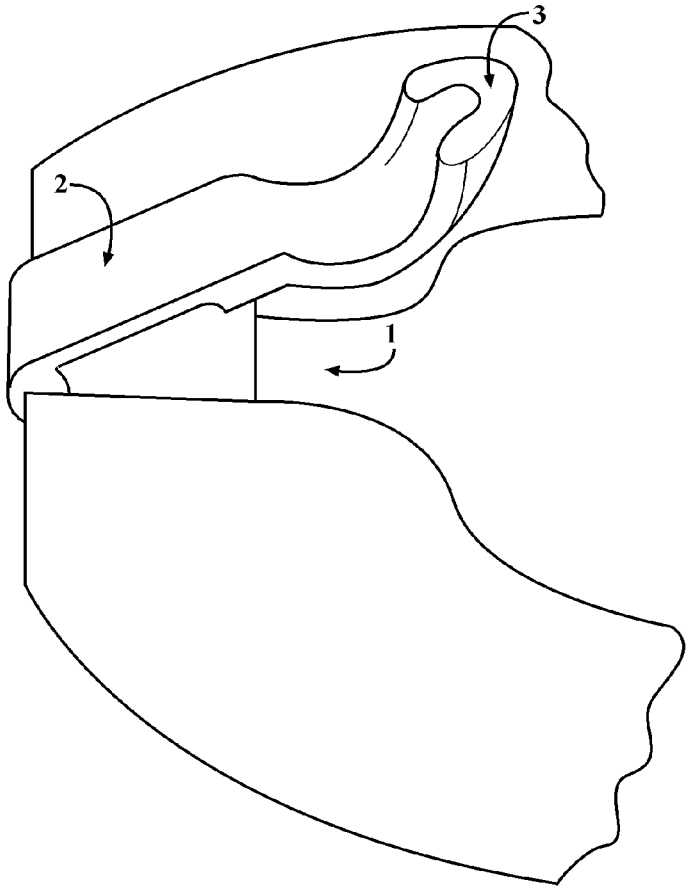
FIG. 6

TOILET SEAT WITH ANOCOCCYGEAL SUPPORT

RELATED APPLICATIONS

The present application is a 35 U.S.C. §371 national stage filing of International Patent Application No. PCT/MY2006/000003, filed Aug. 18, 2006, to which priority is claimed under 35 U.S.C. §120.

FIELD OF THE INVENTION

This invention relates to a toilet seat and more particularly to a toilet seat with therapeutic and prophylactic functions.

BACKGROUND OF THE INVENTION

There are many inventions on toilet seats, most of them have to do with improving the sanitation and cleansing as well as the comfort of the user.

There are a few prior art inventions that devote their attention on enhancing the therapeutic effects of the device. One of these earlier patents is found in U.S. Pat. No. 4,244,063 which describes a therapeutic toilet seat for helping to induce bowel movements comprising of a elongated buttock supporting member having a general curvature to overlie a portion of the toilet bowl upper surface with corresponding inner portion contoured concavely and outer portion contoured convexly to support the buttocks.

There is another invention found in Canadian Patent No. 2,231,420 also entitled "therapeutic toilet seat" which provides a different construction and design that is meant to cater for greater comfort of people with various health problems.

Another recent invention is found in US Application Publication No. 2002/0053103 entitled "Toilet seat with twin protrusions having an egg shape" to assist in easy evacuation of the user by massaging lower regions of the rectum in cyclic motions.

Yet another recent invention is found in US Application Publication No. 2004/0194197 Entitled "Toilet seat with therapeutic features" which is essentially a toilet seat which claims to be designed to enable the user to exert pressure on a specific group of muscles at the base of the coccyx to assist in evacuation.

Constipation is a common major problem in our life. Constipation is defined as problem with the following symptom or symptoms: —

(i) difficulty during defecation (ii) consistency of stool (iii) infrequency of defecation—less than 3 times per week (iv) sensation of incomplete evacuation Formation of hard stools is one of the main causes of constipation. Hard stool formation is due to many factors, usually influenced by our eating habits and life style (busy schedule, stress, depression, etc.) and lack of intake of fibre and water.

Hard stool requires straining during defecation, which is one of the causes of hemorrhoids or piles and anal fissure due to the overstretching of the anal opening by hard stool. Anal fissure may complicate to more serious conditions like perianal abscess.

Straining is also bad for other medical conditions such as hernia, and rectal pro-lapse and also to heart and post operative patients. Besides it is also painful and a waste of time.

The process of defecation is initiated by pressure exerted on to the rectal wall by the faeces. It involves peristalsis of the rectum and relaxation of the anal sphincter, helped by voluntary increase of intra-abdominal pressure resulting from the contraction of abdominal wall muscles (straining). Faeces travel along the rectum by following the bony curvature of the sacrum and coccyx. Beyond which faeces push on the anococcygeal part of the pelvic floor which is practically unsupported, before it reaches the anus. When it is coming out of the anus, it stretches the anal opening, overstretches particularly the posterior quadrant (6 o'clock position) of the anus. This is the mechanism how hard stools lead to anal fissure. Defecation is routine and unavoidable, the same process of continuously repeated overstretching will prevent the healing of anal fissure which may complicate to other related problems above-mentioned.

That is why anal fissure often goes chronic and difficult to treat and almost always on 6 o'clock position of anus.

Conventional treatment ranges from conservative treatments to invasive operations.

Conservative treatments include increase fibre and water intake; encourage regular bowel habits, of which for many patients, compliance is a big problem.

Operative measures include: —

1. Forceful dilatation of the anal sphincter under general anaesthesia which may lead to faecal incontinence lasting possibly for a week or ten days.

2. Lateral anal sphincterotomy which involves the cutting of transverse fibres of the internal sphincter in the floor of fissure. After the operation, the wound is left open.

The after treatment comprises of attention to bowels, daily bath and dilatation of the anus by anal dilator until the wounds heal, which usually take about 3 weeks.

Whereas, in the prior art inventions particularly in U.S. Pat. No. 4,244,063 and more recently found in Canadian Patent No. 2,231,420 both providing for a recess, gap, split or an opening at the rear portion of the toilet seat which would provide greater comfort to those individuals which conditions of posterior region ailments including, for example, tailbone injuries, sciatica or lumbar problems and conditions, they do not address the problem of providing adequate support to the anococcygeal part of the pelvic floor which is the essential part requiring support to prevent straining and overstretching of the anus.

Although in U.S. Patent Application No. 2004/0194197 the invention professes to exert pressure on that specific group of muscles at the base of the coccyx, it would not be effective because it does not provide a gap or recess to accommodate the coccyx, while in use, the tip of coccyx and the invention will press upon each other causing discomfort and may also cause injury to the coccyx before the invention can provide effective pressure to the anoccocygeal part of the pelvic floor.

SUMMARY OF THE INVENTION

In view of the foregoing problems inherent in the known types of toilet seats found in prior art, the present invention provides for simple, effective and inexpensive solution to the problem, by providing for a toilet bowl seat which comprises of an additional tongue-like projection located at the posterior part of the toilet seat to support anococcygeal part of the pelvic floor (which is in normal circumstances practically unsupported) during the process of defecation while seated on the toilet bowl together with a split opening or depression at the posterior end of the seat which will help to reduce the pressure exerted on the body when seated on the toilet seat thus reducing pain and discomfort to the tailbone particularly.

The present invention thus helps in the process of defecation and prevent unnecessary straining by correcting the direction of the faeces and by guiding it more anteriorly towards the anus opening and not to the posterior part of the anus. Hence it prevents the overstretching of the posterior quadrant of the anus. Enhance reflex of defecation, by providing a rigid support to the pelvic floor. The pressure exerted by the faeces on the rectal wall can be increased, thereby bringing about effective stimulation of the rectal wall which leads to stronger reflex of defecation.

The present invention will provide comfort to those individuals with conditions of posterior region, including but not limited to, tailbone injuries, as well as those with conditions of the lower back, including sciatica or lumbar problems.

The present invention not only provides adequate support to the anococcygeal part of the pelvic floor, but also provides for greater comfort and relief to the tailbone too.

For anal fissure this present invention not only treats, but also can prevent anal fissure from happening again. Just by applying pelvic support, similar to the theory of applying perineal support in childbirth delivery, it prevents the overstretching and tear of the anus, and by so doing actually treat the cause of the disease rather the than treat the disease itself.

By smoothening the process of defecation, this invention shortens the actual time of defecation and prevent straining, which in turn helps to benefit many more medical problems like hemorrhoids, fistular in anal, hernia, proctalgia fugax, levator syndrome and a host of many more ailments including those of post operative patients.

The general purpose of the present invention which will be described subsequently in greater detail is to provide for a new toilet seat which has many of the advantages of the toilet seats mentioned heretofore and many novel features that result in a new toilet seat construction which is not anticipated, rendered obvious, suggested or even implied by any of the prior art toilet seats, either alone or in any combination thereof.

BRIEF DESCRIPTION OF THE DRAWINGS

FIG. 4(*b*) is an enlarged view showing the particular portion where the supporting means is located within the recess of the present invention.

FIG. 5 shows the side view of the supporting means.

FIG. 6 shows an oblique view of the invention with the supporting means as a separate foldable piece.

DETAILED DESCRIPTION OF A PREFERRED EMBODIMENT

Figure 1A:
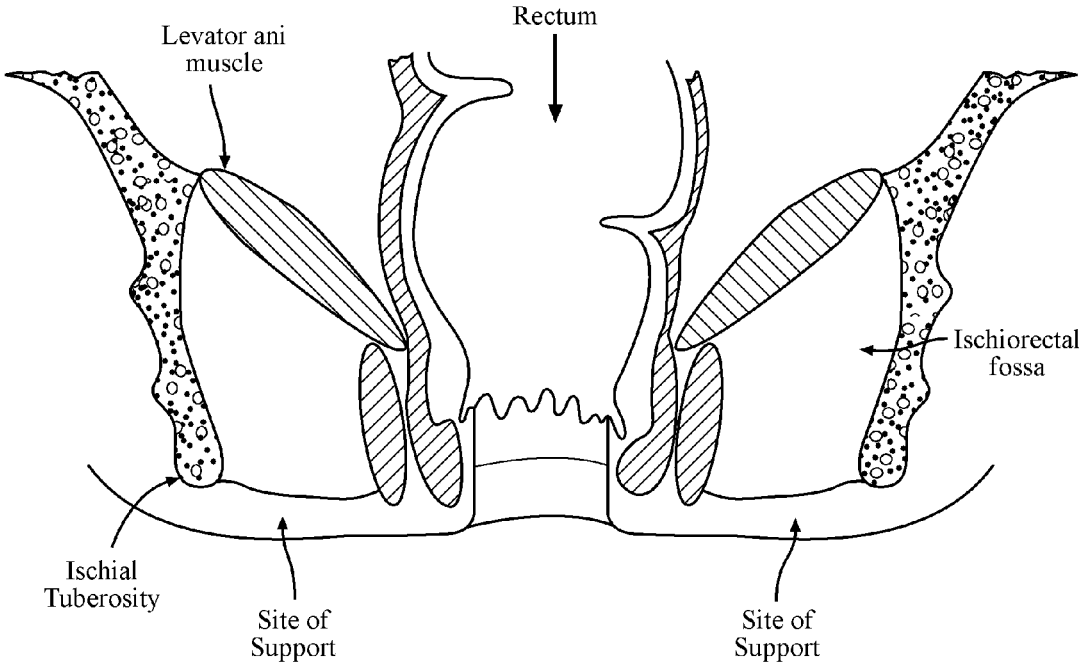
FIG. 1A Prior Art
FIG. 1(*a*) shows the coronal section of the lower part of the pelvic and illustrates the effect of the pressure exerted on either side of anus by prior art devices FIG. 1(*b*) shows the digital section of the pelvic during sitting position on a normal prior art toilet seat.

In this respect, before explaining at least one embodiment of the invention in detail, it is to be understood that the invention is not limited in its application to the details of the construction and to the arrangements of the components set forth in the following description or illustrated in the drawings. The invention is capable of other embodiments and of being practised and carried out in different ways. Also it is to be understood that the phraseology and terminology employed herein are for the description and should not be regarded as limiting.

Figure 1B:
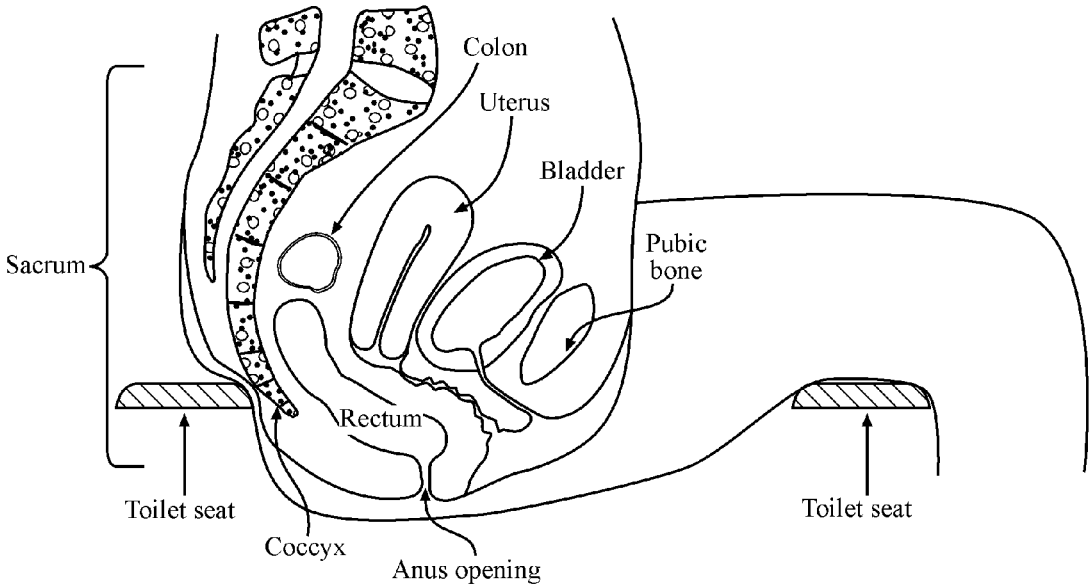
FIG. 1B Prior Art

As shown it FIG. 1(*a*) prior art toilet seat devices are not very effective, because they fail to support and massage the right areas, e.g. being centered on both sides of the anal opening, instead of on the correct location, being the terminal segment of the rectum fixed at the mid line posteriorly following the concave surface of the sacrum and coccyx.

Besides, the location at which they are massaging is through the ischiorectal fossa, which is actually full of fatty tissue, (of which, in an average adult it is between 5 to 6.5 cm excluding the subcutaneous for which it is thicker towards the sides) resulting in cushioning much of the massaging pressure and thereby minimizes the effect of massaging on the rectal wall causing less effective stimulation of defecation.

As illustrated in FIG. 1(*b*), which shows the sagital section of the pelvic sitting on normal prior art of toilet seat, the coccyx is usually resting on the edge of the toilet seat, which causes discomfort and may lead to injury to the coccyx instead, besides there is no additional massage function to stimulate defecation or support to prevent anal fissure.

Figure 2:
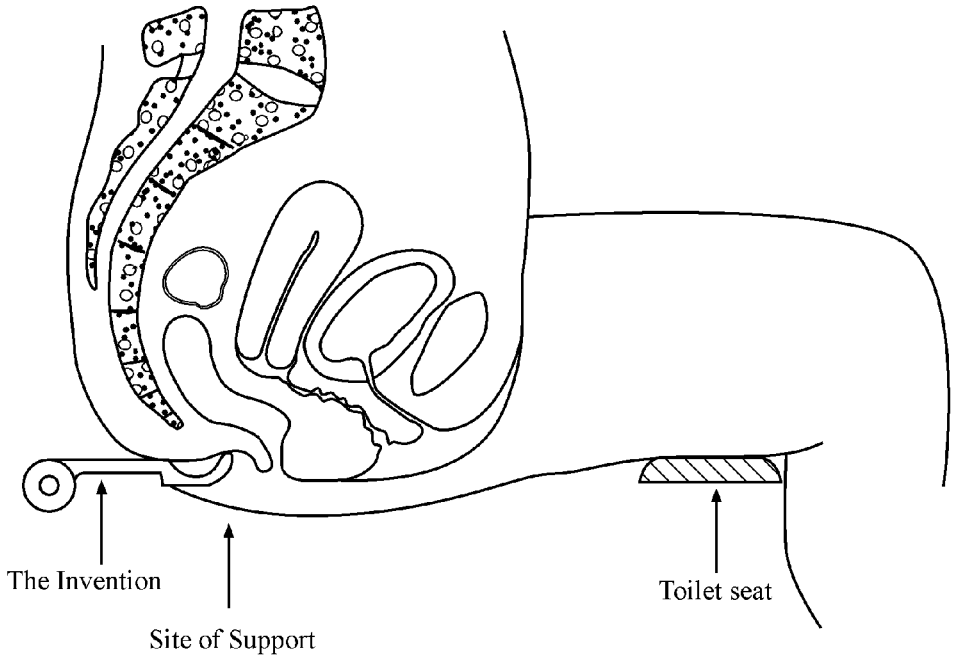
FIG. 2 shows a sagital section of the pelvic during sitting position with support by the present invention.

This is the reason why a surgeon always advises his patient not to sit unnecessarily too long on the toilet seat without defecation. The effect of the present invention is illustrated in FIG. 2 whereby it is shown that the pressure and the support is located at the mid line exactly on the anococcygeal part (at the midline of the pelvic floor and between the tip of the coccyx and anus). At the same time there is a depression to accommodate the tip of coccyx preventing unnecessary pressure on the coccyx, hence avoiding discomfort and injury to the coccyx.

Figure 3:
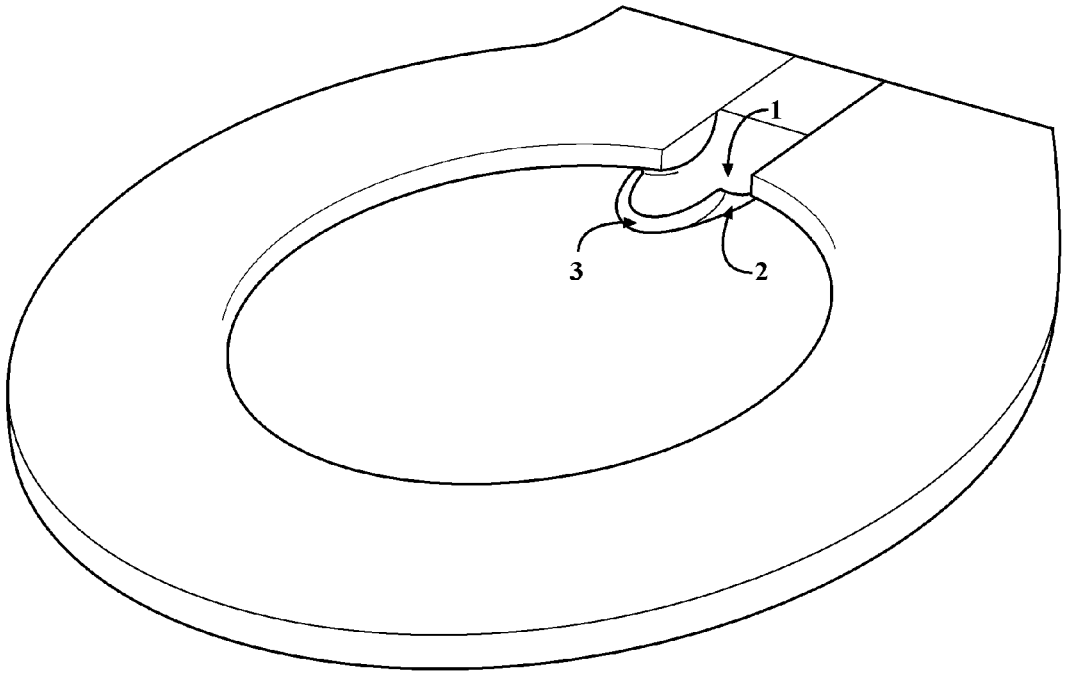
FIG. 3 is a perspective view of the present invention.

The present invention as described in FIG. 3 is of a toilet seat with a split opening or depression located at the posterior end of the toilet seat, thus creating a recess (1) from which a supporting means (2) preferably a tongue-like projection is located within the recess (1), the supporting means (2) protrudes out and upwards at the tip (3) with a curved construction such the recess (1) will avoid exerting direct pressure on the coccyx whereas the raised tip (3) of the supporting means (2) will apply the much needed support to the anococcygeal part of the pelvic floor of the human body.

Figure 4A:
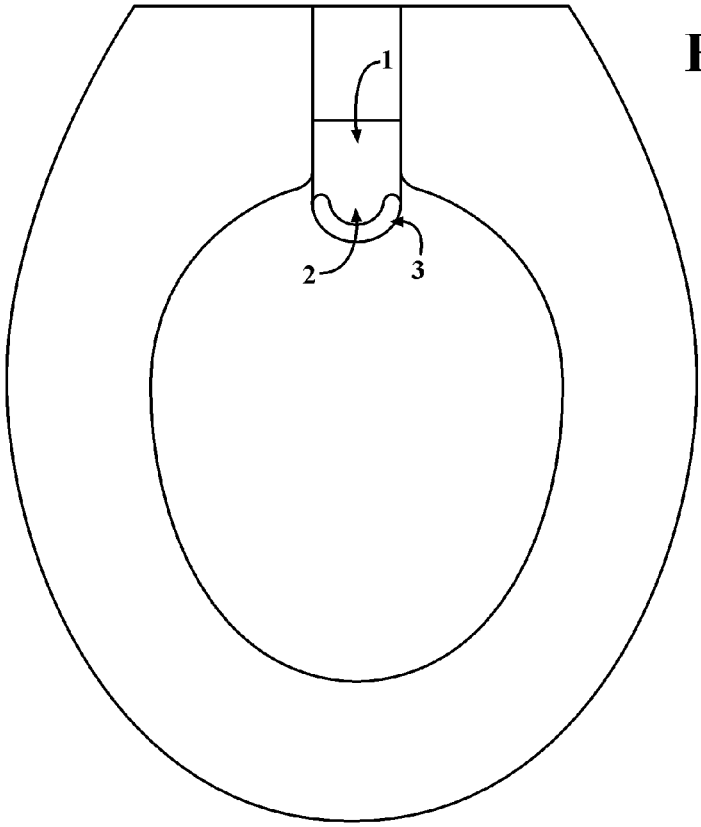
FIG. 4(*a*) is a top view of the present invention.
Figure 4B:
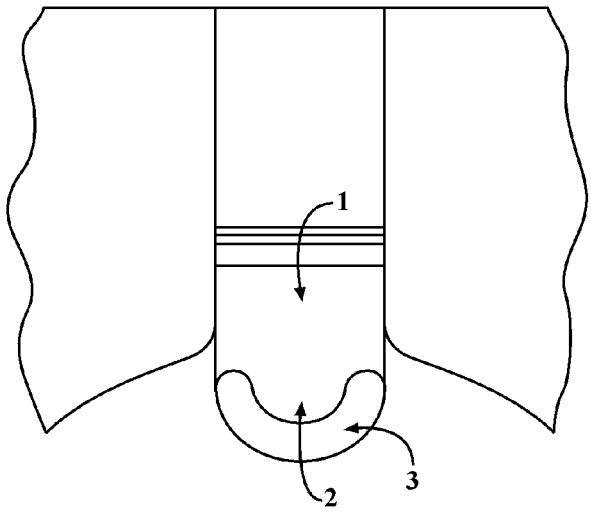

FIG. 4(*a*) shows the top view of the present invention and FIG. 4(*b*) shows an enlarged view of the portion where the recess (1) is located together with the supporting means (2) with the tip (3). Whereas FIG. 5 is the side view of the supporting means (2) illustrating how the curvature formed herein is to accommodate the coccyx and to render support to the anoccocygeal part of the pelvic floor.

A further embodiment of the invention is shown in FIG. 6 where the entire supporting means (2) is a separate retractable or foldable piece that is attached to the rear of the toilet seat, which can be either detached or folded back to render the user a choice.

As such those skilled in the art will appreciate that the conception, upon which this disclosure is based, may readily be utilized as a basis for the designing of other structures, methods and systems for carrying out the several purposes of the present invention. It is important therefore that the claims be regarded as including such equivalent construction insofar as they do not depart from the ambit and scope of the present invention.

REFERENCES CITED

Patent Documents

U.S. Pat. No. 4,244,063
Canadian Patent No. 2,231,420
US Application Publication No. 2002/0053103
US Application Publication No. 2004/0194197

Other Publications

1. Review of Medical Physiology—William F Ganong
2. Bailey and Loves's—Short Practice of Surgery
   Revised by A. J. Harding Rains
   Charles V. Mann
3. Last's Anatomy Regional and Applied
   Edited by R. M. H. McMinn
4. Anatomy—A Regional Atlas of the Human Body
   Carmine D. Clemente
5. Human Anatomy Regional and Applied Volume
   Lower Limbs and Abdomen
   B. D. Chaurasia

The invention claimed is:

1. A toilet seat comprising a structure for supporting a user, the structure surrounding an opening, said seat comprising;

a recess located in the structure at a posterior end of the toilet seat, a supporting means located in said recess and protruding outwards and upwards therefrom towards the opening, said supporting means having a curved configuration forming a recess and terminating in an adjacent tip, whereby, when a user is seated on the seat for defecation, the recess in said supporting means will avoid exerting direct pressure on a user's coccyx, while the tip will provide support to the an anoccocygeal part of the user's pelvic floor.

2. A toilet seat as claimed in claim 1, wherein the supporting means is a separate attachment to the toilet seat.

3. A toilet set as claimed in claim 1, wherein the supporting means is foldable and retractable.

4. A toilet seat as claimed in claim 2, wherein the supporting means has a tongue-like shape.

5. A toilet set as claimed in claim 2, wherein the supporting means is foldable and retractable.

* * * * *